US009160091B2

(12) United States Patent
Tsai et al.

(10) Patent No.: US 9,160,091 B2
(45) Date of Patent: Oct. 13, 2015

(54) ELECTRICAL CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/333,195

(22) Filed: Jul. 16, 2014

(65) Prior Publication Data

US 2015/0024636 A1 Jan. 22, 2015

(30) Foreign Application Priority Data

Jul. 17, 2013 (CN) ..... 2013 2 0425241 U

(51) Int. Cl.

| | |
|---|---|
| ***H01R 12/71*** | (2011.01) |
| *H01R 12/72* | (2011.01) |
| *H01R 13/24* | (2006.01) |
| *H01R 13/41* | (2006.01) |

(52) U.S. Cl.

CPC ..... *H01R 12/716* (2013.01); *H01R 12/721* (2013.01); *H01R 13/2442* (2013.01); *H01R 13/41* (2013.01)

(58) Field of Classification Search

USPC ..... 439/630, 638, 79, 65, 660

See application file for complete search history.

(56) References Cited

FOREIGN PATENT DOCUMENTS

TW M449368 U 3/2013

OTHER PUBLICATIONS

English abstract for TWM449368; published on Mar. 21, 2013 and retrieved on Aug. 18, 2014.

*Primary Examiner* — Alexander Gilman

(74) *Attorney, Agent, or Firm* — Novak Druce Connolly Bove + Quigg LLP

(57) ABSTRACT

An electrical connector to be connected with an Next Generation Form Factor (NGFF) interface is disclosed, including a base, a plurality of first terminals, and a plurality of second terminals. A plurality of first terminal slots parallel disposed on one side of the base for the first terminals to be plugged thereinto. A plurality of second terminal slots parallel disposed on the other side of the base for the second terminals to be plugged thereinto. The first terminal has a stair-like structure having a first plugging part, a first connecting part, a second connecting, a third connecting part, and a first bonding part. The present invention discloses an improved first terminal structure from having only one abutment piece to having a stair-like structure with a plurality of connecting parts.

5 Claims, 9 Drawing Sheets

ELECTRICAL CONNECTOR

BACKGROUND OF THE INVENTION

1. Field of the Invention

The present invention relates to electrical connectors, and, more particularly, to an electrical connector used to connect with a Next Generation Form Factor (NGFF) interface.

2. Description of Related Art

As the technology for developing electronic products is rapidly growing, many different types of electronic devices have been developed including personal computers, smart phones or tablets. The goal for today's electronic device is centered towards miniaturization, high operational speed, and high functionality.

In recent years, the industry focuses heavily on improving Notebook and Ultrabook by using mSATA as an interface to connect with SSD. However, the function of mSATA in practice does not produce satisfactory results as expected. The advantages of using mSATA are few compared to its price. Besides, the operational speed is no longer sufficient to meet user's requirement.

In view of this, related art in the field is now committed to research in a new interface called Next Generation Form Factor (NGFF), or abbreviated as M2. NGFF can support SATA and PCIe interface, which can substitute mSATA interface used today. The specification of NGFF has many advantages including being smaller in size, higher power efficiency and higher transmission speed. Moreover, different standard sizes have been created to accommodate different needs in order to fit to different designs of different purposes.

Taiwanese Patent No. m449368 disclosed a card connector comprising an insulative body, a plurality of first terminals, and a plurality of second terminals. The ends of the first and second terminals are plugged in the insulative body and arranged in an alternate arrangement. Each of the first terminals has a first bonding end that extends to the outer part of the insulative body for bonding with the first bonding end of the circuit board. Each of the second terminals has a second bonding end that extending to the outer part of the insulative body for bonding with the second bonding end of the circuit board, allowing the card connector to be securely positioned on the circuit board.

Nevertheless, according to the drawings of the previously mentioned patent, the part of first terminal which is exposed from the insulative body of the NGFF connector disclosed by the previously mentioned patent is long and each of the first terminals is not securely fastened with any petitioners, such that first terminals can easily become deformed, causing failure to be successfully bonded onto the circuit board, resulting in poor yield.

SUMMARY OF THE INVENTION

In view of the foregoing problems, the present invention provides an electrical connector to solve bending and poor evenness of the bonding part, comprising: a base having a plurality of first terminal slots parallel disposed on one side of the base and a plurality of second terminal slots parallel disposed on the other side of the base; a plurality of first terminals respectively plugged in the first terminal slots, each of the first terminal having: a first plugging part plugged in the first terminal slot and having a first abutment piece that abuts an inner surface of the first terminal slot via a side surface thereof, allowing the first connecting part to be positioned in the first terminal slot; a first bending part connected with an end of the first plugging part; a first connecting part having one end connected to the first bending part; a second bending part connected with the other end of the first connecting part; a second connecting part having one end connected with the second bending part and including a second abutment piece; a third bending part connected with the other end of the second connecting part; a third connecting part having one end connected with the third bending part; a fourth bending part connected with the other end of the third connecting part; and a first bonding part connected with the fourth bending part; wherein the base has a plurality of first dividing boards disposed among two sides of the first connecting part of each of the first terminal substrates, allowing two adjacent ones of the first terminals to be electrically isolated from each other, and each of the first dividing boards extends from the side of the first connecting part to a side of the second connecting part, allowing the second abutment piece of the second connecting part to abut and be securely positioned onto a side surface of the first division board; and a plurality of second terminals respectively plugged into the second terminal slots, each of the second terminals having: a second plugging part plugged into the second terminal slot; a fifth bending part connected with the second plugging part; an extending part having one end connected with the fifth bending part; a sixth bending part connected with the other end of the extending part; and a second bonding part connected with the sixth bending part.

In an embodiment, grooves are formed on two sides of each of the dividing boards and corresponding to the side surfaces of the second abutment piece, to firmly position the second connecting part between the two first dividing boards with the side surface of the second abutment piece abutting against the grooves.

In summary, the electrical connector according to the present invention improves the structure of the first terminal, by forming a stair-like structure with the second connecting part, the third connecting part, the first bending part, the second bending part and the third bending part of the exposed portion of the first terminal, thereby solving the foregoing problems that too much of the first terminal is exposed from the base without any abutment piece, which subsequently caused irregular bending and poor evenness of the surface of the first terminal.

Besides, a dividing board is disposed between two adjacent ones of the connecting parts, allowing the first terminals to have better high frequency characteristics, preventing the first terminal to be too close causing short circuit as a result of arc breakdown during voltage test.

BRIEF DESCRIPTION OF DRAWINGS

The present invention can be more fully understood by reading the following detailed description of the preferred embodiments, with reference made to the accompanying drawings, wherein.

DETAILED DESCRIPTION OF PREFERRED EMBODIMENTS

The present invention is described in the following with specific embodiments, so that one skilled in the pertinent art can easily understand other advantages and effects of the present invention from the disclosure of the present invention.

It is to be understood that the scope of the present invention is not limited to the disclosed embodiments. On the contrary, it is intended to cover various modifications and similar arrangements. The scope of the claims, therefore, should be accorded the broadest interpretation so as to encompass all such modifications and similar arrangements. In addition, words such as "on", "top" and "a" are used to explain the preferred embodiment of the present invention only and should not limit the scope of the present invention.

Figure 1:
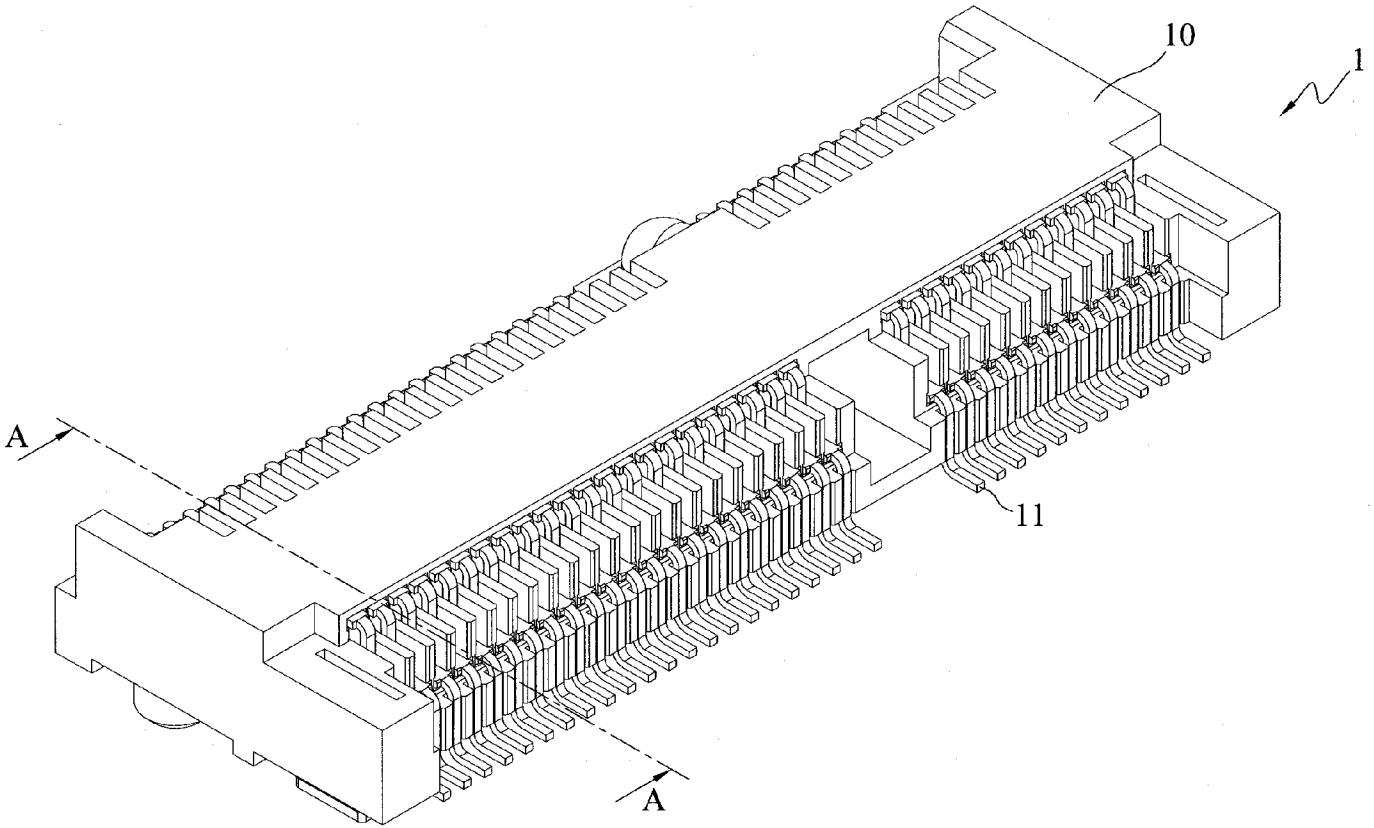
FIG. 1 is an isometric view of an electrical connector according to the present invention.
Figure 2:
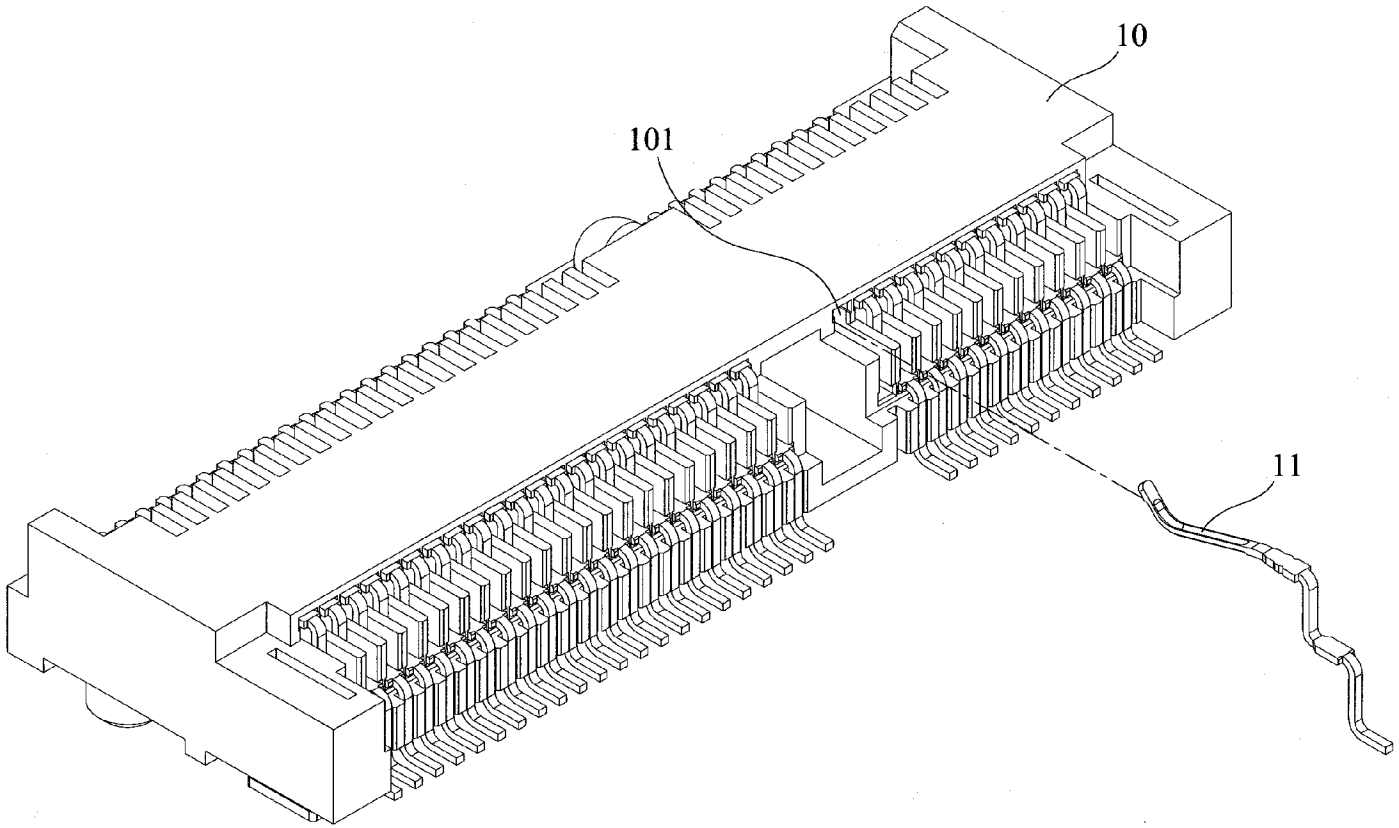
FIG. 2 is an isometric view showing one of first terminals detached from a base of the electrical connector.
Figure 3:
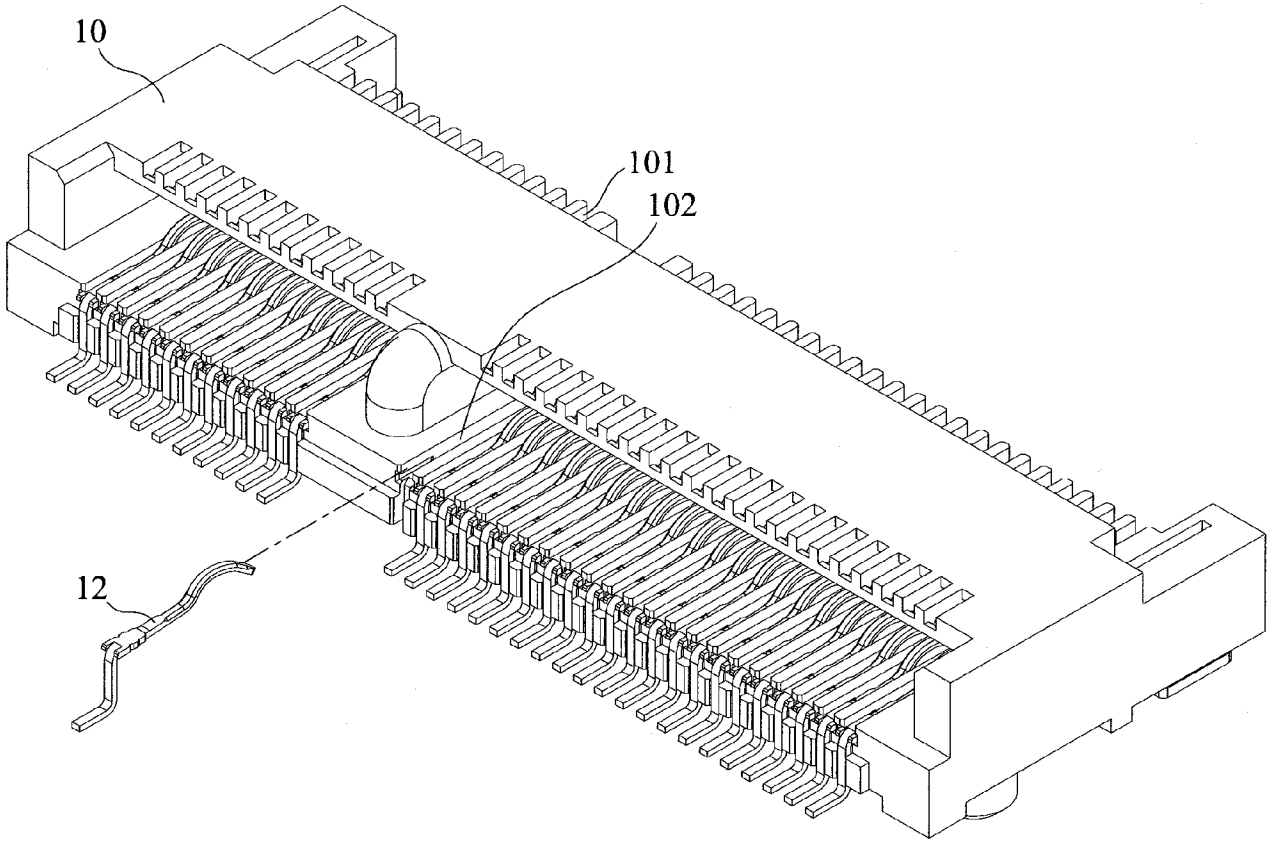
FIG. 3 is an isometric view showing one of second terminals detached from the base of the electrical connector.

FIGS. 1 to 3 show an electrical connector 1 according to the present invention. FIG. 1 is the 3 D view of the electrical connector 1 according to the present invention. FIG. 2 is the detached schematic view showing first terminal 111 and a base 10 of the electrical connector 1. FIG. 3 is a detached schematic view showing second terminals 12 and the base 10. The electrical connector 1 comprises the base 10, the first terminals 11, and the second terminals 12.

A plurality of first terminal slots 101 is formed on one side of the base 10 for the first terminals 11 to be plugged thereinto. A plurality of second terminal slots 102 are formed on the other side of the base 10. Each of the first terminals 11 is plugged in the corresponding first terminal slot 101, and each of the second terminals is plugged in the corresponding second terminal slot 102.

Figure 4:
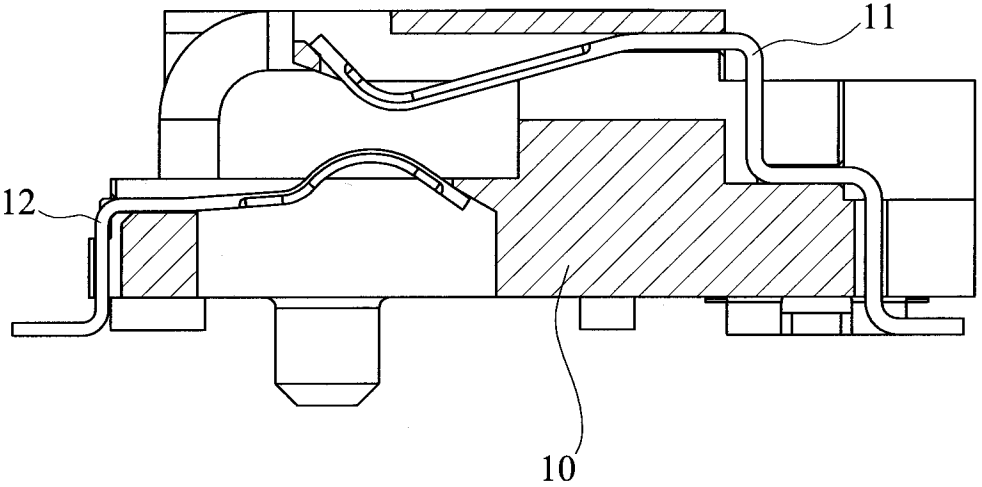
FIG. 4 is a cross-sectional view along a line A-A of FIG. 1.

Referring together with FIG. 4, with a line A-A as a cross-sectional line, after the first terminals 11 and the second terminals 12 are plugged into the base 10, the first terminals 11 and the second terminals 12 are arranged in an alternate way in the base 10.

Figure 5:
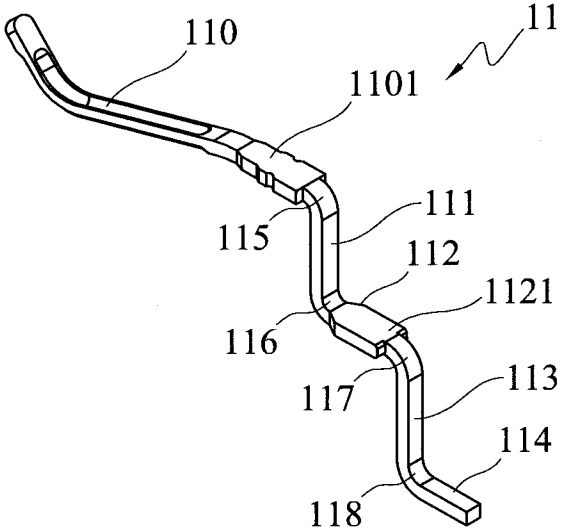
FIG. 5 is an isometric view of one of the first terminals.
Figure 6:
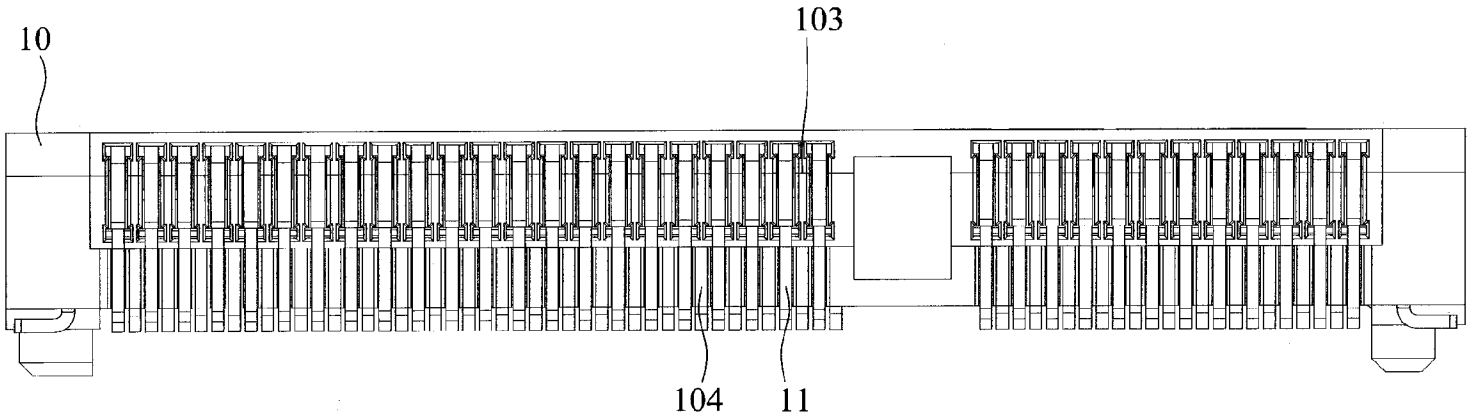
FIG. 6 is a side elevational view of the first terminals and the base.

FIG. 5 is the 3D view of the first terminals 11, and FIG. 6 is the assembly schematic view showing the first terminals 11 and the base 10. The first terminal 11 has a first plugging part 110, a second connecting part 111, a second connecting part 112, a third connecting part, a first bonding part 114, a first bending part 115, a second bending part 116, a third bending part 117, and a fourth bending part 118. The first plugging part 110 is plugged in the first terminal slot 101. The first bending part 115 is connected with the end of the first plugging part 110 and exposed from the first terminal slot 101. One end of the first connecting part 111 is connected to the first bending part 116. The second bending part 116 is connected to the other end of the first connecting part 111. The second connecting part 112 has one end connected with the second bending part 116, and the other end connected to the third bending part 117. One end of the third connecting part 113 is connected with the third bending part 117. The fourth bending part 118 is connected with the other end of the third connecting part 113. The first bonding part 114 is connected to the fourth bending part 118. The first terminal 11 of the electrical connector 1 according to the present invention thus has a stair-like structure. The first plugging part 110 has a first abutment piece 1101. When the first plugging part 110 is plugged in the first terminal slot 101, the two sides of the first abutment piece 110 abut against the inner surface of the first terminal slot 101, allowing the first plugging part 110 to be positioned in the first terminal slot 101.

In FIG. 6, the electrical connector 1 according to the present invention, a first dividing board 103 is formed on both sides of each of the first connecting part 111, for electrically isolating the adjacent first terminals 11. Each of the first dividing boards 103 extends from the side of the first connecting part 111 to the side surface of the second connecting part 112. Apart from being able to electrically isolate the adjacent first terminals 11, it also makes the electrical connector 1 according to the present invention to have better high frequency characteristic. Moreover, during the withstand pressure test on each of the first terminals 11, the problem of short circuit due to the arc breakdown as a result of two adjacent ones of the first terminals 11 being too close can be prevented. In addition, each of the first dividing boards 103 can also be used to isolate metal copper wires and scraps to prevent short circuit. In other words, copper scraps can cause short circuit of two adjacent ones of the first terminals 11, which can be prevented through the function of the first dividing board 103.

Besides, not only the first terminal 11 has a first abutment piece 1101, the second connecting part 112 also has a second abutment piece 1121. When the first terminal 11 is plugged in the firth terminal slot 101 of the base 10, two sides of the second abutment piece 1121 abut against the side surfaces of the first dividing board 103 of the base 10.

Figure 7:
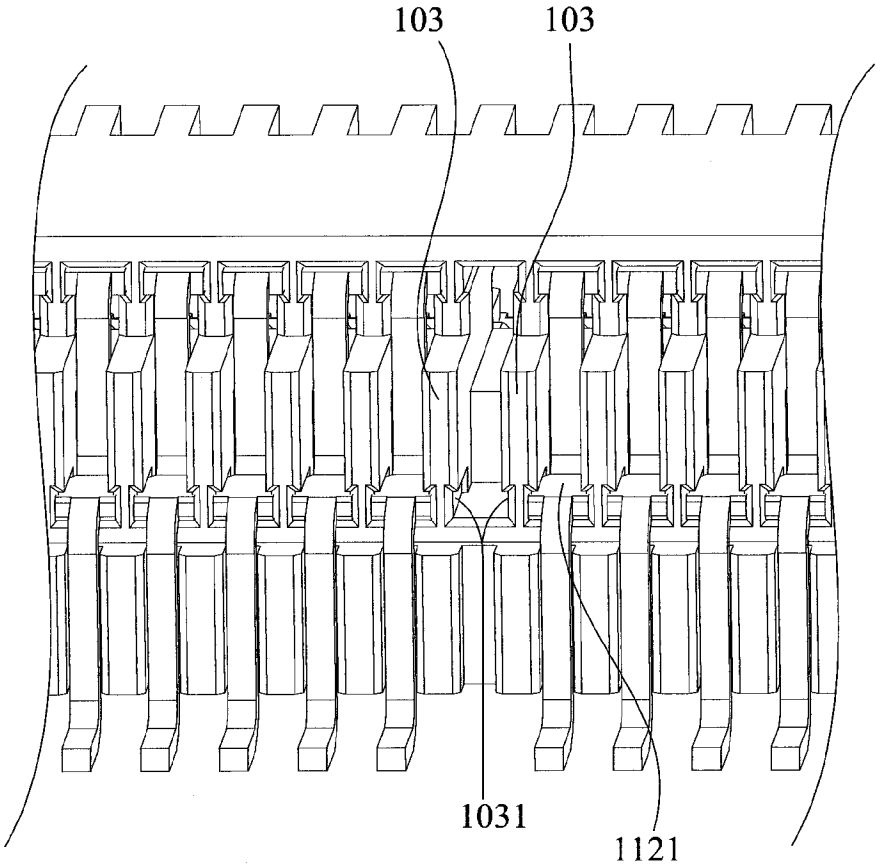
FIG. 7 is a side isometric view of the second abutment piece and the first dividing board.

FIG. 7 is an assembly schematic view of the second abutment piece 1121 and the first dividing board 103. Grooves 1031 are formed on two sides of the first dividing board 103, at positions corresponding to the second abutment piece 1121. When the first terminal 11 and the base 10 are coupled together, the two sides of the abutment piece 1121 abut against the grooves 1031 of the first dividing board 103 formed on the two sides of the abutment piece 1121.

The first terminal 11 according to the present electrical connector 1 has an additional second connecting part 112, as compared to the conventional first terminal 11, so as to improve on the drawback that the vertical distance between the first plugging part 110 and the first bonding part 114 of the conventional first terminal 11 being too long causing irregular bending (pin warpage as known by skilled of art) and poor planarity. Through abutting the first abutment piece 1101 against the inner surface of the first terminal slot 101 and abutting the second abutment piece 1121 against the grooves of the first dividing board 103, the first terminal 11 according to the present invention thereby has a better positioning compared to the conventional first terminal 11 which only has one first abutment piece 1101.

In addition to forming the first dividing board 103 in the electrical connector 1 according to the present invention 1, a plurality of second dividing boards 104 are disposed on two sides of the third connecting part 113. The second dividing boards 104 are used to specify the position of the third connecting part 113 of each first terminal 11, to prevent irregular bending of the third connecting part 113 (pin warpage) and poor planarity, so as to solve the warpage of the first terminals 11 and poor planarity problems caused by not having dividing boards in the prior art.

Besides, the objective of the present invention is to solve irregular bending problem of the first terminal 11, therefore in ideal situation, the distance between the second connecting part 112 and the first bonding part 114 should be as small as possible. In other words, the length of the third connecting part 113 determines the occurrence of bending problem of the third connecting part and determines the occurrence of bending of the first terminal 11.

Figure 8:
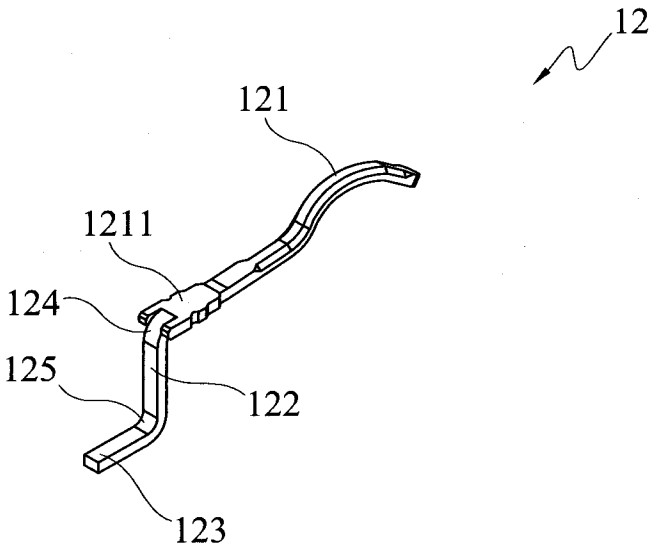
FIG. 8 is an isometric view of the second terminals according to the present invention.
Figure 9:
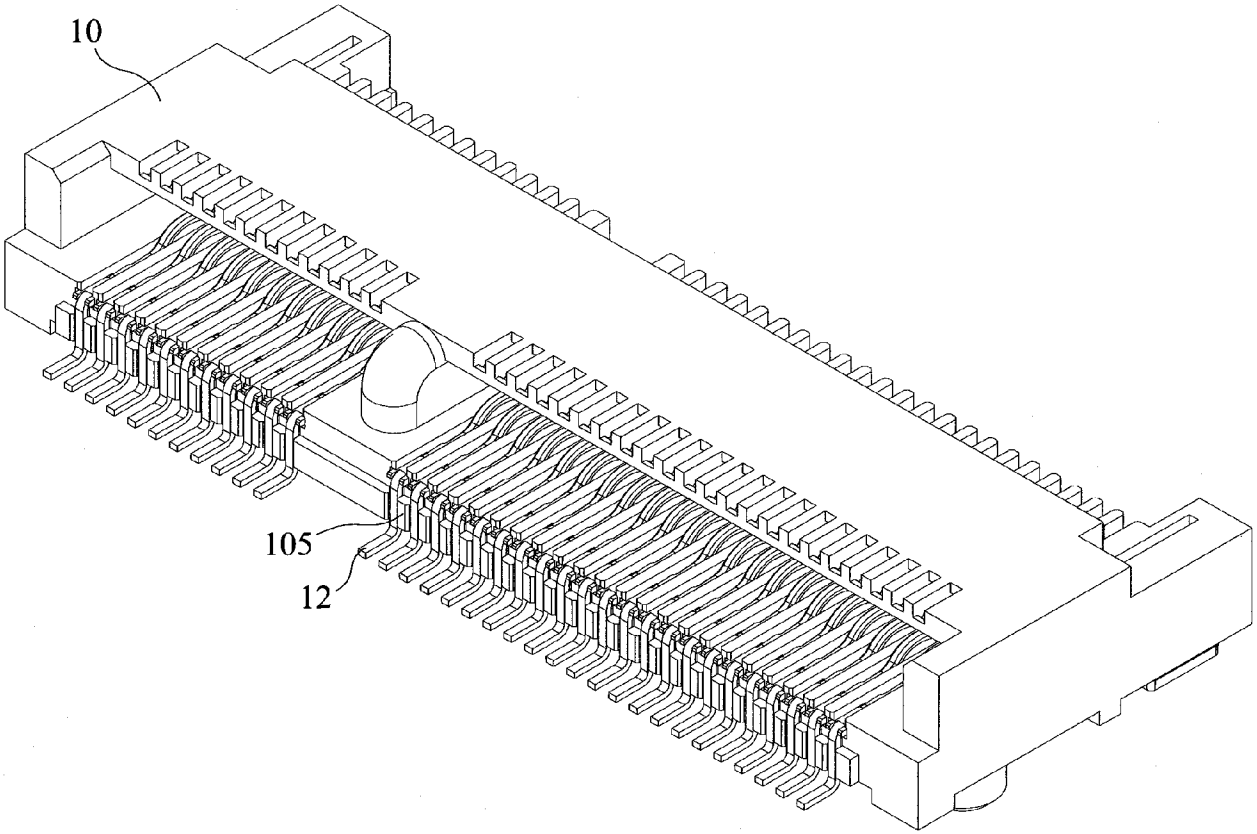
FIG. 9 is an isometric assembled view of the second terminals and the base.

FIG. 8 is a 3D view of the second terminals 12. FIG. 9 is an assembly schematic view of the second terminals 12 and the base 10. The second terminal 12 has a second plugging part 121, an extending part 122, a second bonding part 123, a fifth bending part 124, and a sixth bending part 125. The fifth bending part 124 is connected to the second plugging part 121, the extending part 122 has one end connected to the fifth bending part 124 and the other end connected to the sixth bending part 125, and the second bonding part 123 is connected to the sixth bending part 125.

The second terminal 12 is plugged in the second terminal slot 102 of the base 10 via the second plugging part 121, and the extending part 122, the second bonding part 123, the fifth bending part 124 and the sixth bending part 125 are exposed from the base 10. The second plugging part 121 has a third abutment piece 1211. The second plugging part 121 can be plugged into and positioned firmly on the second terminal slot 102 of the base 10, with the two sides of the third abutment piece abutting against the inner surface of the second terminal slot 102.

A plurality of third dividing boards 105 are disposed on two sides of the extending part 122 of each of the second terminals 12, to electrically isolate adjacent two of the second terminals 12, as well as to assist positioning of each extending part 122.

The present invention has been described using exemplary preferred embodiments. However, it is to be understood that the scope of the present invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. An electrical connector, comprising:

a base having a plurality of first terminal slots parallelly disposed on one side of the base and a plurality of second terminal slots parallel disposed on the other side of the base;

a plurality of first terminals respectively plugged in the first terminal slots, each of the first terminal having:

a first plugging part plugged in the first terminal slot and having a first abutment piece that abuts an inner surface of the first terminal slot via a side surface thereof, allowing the first connecting part to be positioned in the first terminal slot;

a first bending part connected with an end of the first plugging part;

a first connecting part having one end connected to the first bending part;

a second bending part connected with the other end of the first connecting part;

a second connecting part having one end connected with the second bending part and including a second abutment piece;

a third bending part connected with the other end of the second connecting part;

a third connecting part having one end connected with the third bending part;

a fourth bending part connected with the other end of the third connecting part; and a first bonding part connected with the fourth bending part;

wherein the base further has a plurality of first dividing boards disposed among two sides of the first connecting part of each of the first terminal substrates, allowing two adjacent ones of the first terminals to be electrically isolated from each other, and each of the first dividing boards extends from the side of the first connecting part to a side of the second connecting part, allowing the second abutment piece of the second connecting part to abut and be securely positioned onto a side surface of the first division board; and a plurality of second terminals respectively plugged into the second terminal slots, each of the second terminals having:

a second plugging part plugged into the second terminal slot;

a fifth bending part connected with the second plugging part;

an extending part having one end connected with the fifth bending part;

a sixth bending part connected with the other end of the extending part; and a second bonding part connected with the sixth bending part.

2. The electrical connector of claim 1, wherein the first plugging part, the first bending part, the first connecting part, the second bending part, the second connecting part, the third bending part, the fourth bending part and the first bonding part of the first terminal are formed in a stair-like structure.

3. The electrical connector of claim 1, further comprising a plurality of second dividing boards disposed on two sides of each of the third connecting parts, to assist positioning the third connecting parts.

4. The electrical connector of claim 1, wherein the first terminals and second terminals are arranged vertically in an alternating arrangement in the base.

5. The electrical connector of claim 1, further comprising grooves formed on two sides of each of the first dividing boards and corresponding to the side surfaces of the second abutment pieces, to securely position the second connecting part between the two first dividing boards with the side surfaces of the second abutment piece abutting against the grooves.

* * * * *